US011603708B2

(12) United States Patent
Selvam

(10) Patent No.: US 11,603,708 B2
(45) Date of Patent: Mar. 14, 2023

(54) LINKAGE ASSEMBLY FOR DRILLING MACHINE

(71) Applicant: Caterpillar Global Mining Equipment LLC, Denison, TX (US)

(72) Inventor: Sudhagar Selvam, Chennai (IN)

(73) Assignee: Caterpillar Global Mining Equipment LLC., Denison, TX (US)

( * ) Notice: Subject to any disclaimer, the term of this patent is extended or adjusted under 35 U.S.C. 154(b) by 522 days.

(21) Appl. No.: 16/717,851

(22) Filed: Dec. 17, 2019

(65) Prior Publication Data

US 2021/0180406 A1 Jun. 17, 2021

(51) Int. Cl.

| | |
|---|---|
| ***E21B 7/02*** | (2006.01) |
| *E21D 20/00* | (2006.01) |
| *E21B 19/087* | (2006.01) |
| *E21B 15/04* | (2006.01) |
| *E21B 15/00* | (2006.01) |

(52) U.S. Cl.

CPC ..... *E21B 7/025* (2013.01); *E21B 7/022* (2013.01); *E21B 15/006* (2013.01); *E21B 15/04* (2013.01); *E21B 19/087* (2013.01); *E21D 20/003* (2013.01)

(58) Field of Classification Search

CPC . E21B 7/02; E21B 7/022; E21B 7/025; E21B 19/08; E21B 19/087

See application file for complete search history.

(56) References Cited

U.S. PATENT DOCUMENTS

| | | | |
|---|---|---|---|
| 3,565,184 | A | 2/1971 | Gustafsson et al. |
| 3,721,304 | A | 3/1973 | Hanson |
| 4,410,049 | A | 10/1983 | Molin |
| 2003/0047359 | A1 | 3/2003 | Shupe |

FOREIGN PATENT DOCUMENTS

| | | |
|---|---|---|
| EP | 0920567 | 4/2003 |
| KR | 101195476 | 10/2012 |
| WO | WO 98/07952 | * 2/1998 |

* cited by examiner

*Primary Examiner* — Kristyn A Hall

(57) ABSTRACT

A linkage assembly for a drilling machine includes a first arm, a second arm, an actuation member, and a connector assembly. A first end of the first arm is pivotally coupled to a positioning member at a first pivot joint. A first end of the second arm is pivotally coupled to a feed table at a second pivot joint. A first end of the actuation member is pivotally coupled to the feed table at a third pivot joint. The connector assembly is fixedly coupled to a second end of the first arm, and pivotally coupled to a second end of the second arm and a second end of the actuation member. The linkage assembly is adapted to pivot the feed table relative to the positioning member about a pivot axis based on movement of the actuation member between an extended position and a retracted position.

19 Claims, 7 Drawing Sheets

LINKAGE ASSEMBLY FOR DRILLING MACHINE

TECHNICAL FIELD

The present disclosure relates to a linkage assembly for a drilling machine. More particularly, the present disclosure relates to the linkage assembly for a feed assembly associated with the drilling machine.

BACKGROUND

A drilling machine, such as a boom mounted drilling machine, includes a linkage assembly provided in association with a boom and a feed assembly of the drilling machine. The linkage assembly includes a number of interconnecting components, such as a number of arms, joints, actuators, and so on that may be adapted to move relative to one another. Based on an operating position of the linkage assembly, the linkage assembly provides swing movement of the feed assembly relative to the boom of the drilling machine.

In many situations, the linkage assembly may include components manufactured by casting process. In such a situation, the components may have a substantial weight, in turn, increasing weight and cost of the linkage assembly. Additionally, the components may be interconnected to one another in a relatively less optimized configuration. As a result, a relatively higher force may be required to actuate the linkage assembly, in turn, reducing efficiency and performance. Hence, there is a need for an improved linkage assembly for such applications.

European Patent Number 920567 describes a drill rig having a carrier, a boom, and a feed device. The feed device is rotatably connected with the boom by means of a rotation device. The rotation device includes a hydraulic cylinder provided between the feed device and a first link. The first link is rotatably connected with the feed device and a second link. The second link is rotatably connected with the boom. The feed device is adapted to be swung about an axis of rotation from a position at least 30 degrees (°) to one side of a vertical line to a position at least 90° to other side of the vertical line by means of the hydraulic cylinder.

SUMMARY OF THE DISCLOSURE

In an aspect of the present disclosure, a linkage assembly for a drilling machine is provided. The linkage assembly includes a first arm defining a first end and a second end disposed opposite to the first end. The first end of the first arm is pivotally coupled to a positioning member at a first pivot joint. The linkage assembly includes a second arm defining a first end and a second end disposed opposite to the first end. The first end of the second arm is pivotally coupled to a feed table at a second pivot joint. The linkage assembly also includes an actuation member defining a first end and a second end disposed opposite to the first end. The first end of the actuation member is pivotally coupled to the feed table at a third pivot joint. The linkage assembly further includes a connector assembly fixedly coupled to the second end of the first arm, and pivotally coupled to each of the second end of the second arm and the second end of the actuation member. The linkage assembly is adapted to pivot the feed table relative to the positioning member about a pivot axis based on movement of the actuation member between an extended position and a retracted position.

In another aspect of the present disclosure, a feed assembly for a drilling machine is provided. The feed assembly includes a feed table adapted to receive a drill assembly. The feed assembly also includes a positioning member pivotally coupled to each of the feed table and a boom member associated with the drilling machine. The feed assembly further includes a linkage assembly operably coupled to the feed table and the positioning member. The linkage assembly includes a first arm defining a first end and a second end disposed opposite to the first end. The first end of the first arm is pivotally coupled to the positioning member at a first pivot joint. The linkage assembly includes a second arm defining a first end and a second end disposed opposite to the first end. The first end of the second arm is pivotally coupled to the feed table at a second pivot joint. The linkage assembly also includes an actuation member defining a first end and a second end disposed opposite to the first end. The first end of the actuation member is pivotally coupled to the feed table at a third pivot joint. The linkage assembly further includes a connector assembly fixedly coupled to the second end of the first arm, and pivotally coupled to each of the second end of the second arm and the second end of the actuation member. The linkage assembly is adapted to pivot the feed table relative to the positioning member about a pivot axis based on movement of the actuation member between an extended position and a retracted position.

In yet another aspect of the present disclosure, a drilling machine is provided. The drilling machine includes a chassis and a boom member movably coupled to the chassis. The drilling machine includes a feed table pivotally coupled to the boom member. The drilling machine also includes a positioning member pivotally coupled to each of the feed table and the boom member. The drilling machine further includes a linkage assembly operably coupled to the feed table and the positioning member. The linkage assembly includes a first arm defining a first end and a second end disposed opposite to the first end. The first end of the first arm is pivotally coupled to the positioning member at a first pivot joint. The linkage assembly includes a second arm defining a first end and a second end disposed opposite to the first end. The first end of the second arm is pivotally coupled to the feed table at a second pivot joint. The linkage assembly also includes an actuation member defining a first end and a second end disposed opposite to the first end. The first end of the actuation member is pivotally coupled to the feed table at a third pivot joint. The linkage assembly further includes a connector assembly fixedly coupled to the second end of the first arm, and pivotally coupled to each of the second end of the second arm and the second end of the actuation member. The linkage assembly is adapted to pivot the feed table relative to the positioning member about a pivot axis based on movement of the actuation member between an extended position and a retracted position.

Other features and aspects of this disclosure will be apparent from the following description and the accompanying drawings.

DETAILED DESCRIPTION

Figure 1:
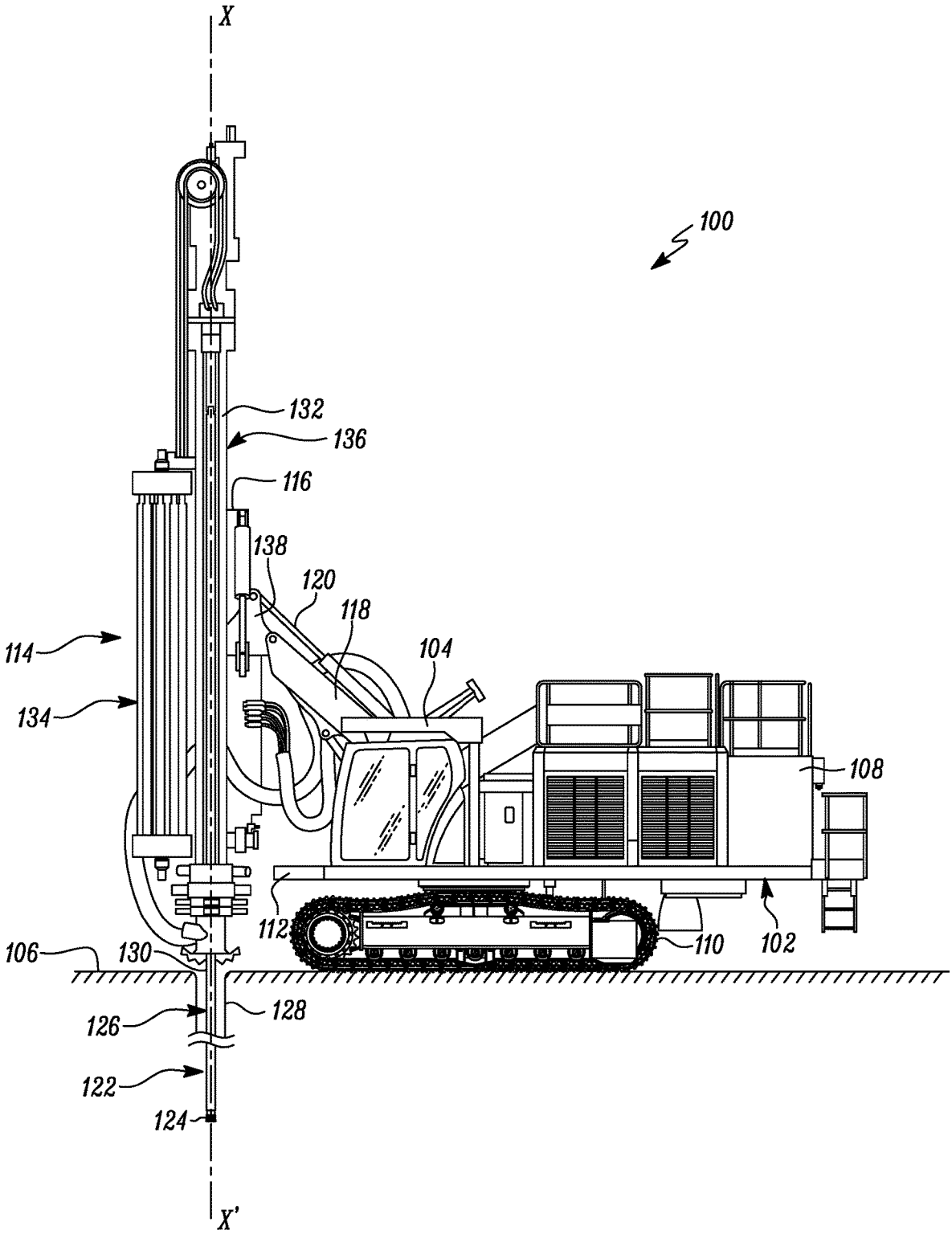
FIG. 1 is a side view of an exemplary drilling machine, according to one embodiment of the present disclosure.

Wherever possible, the same reference numbers will be used throughout the drawings to refer to the same or like parts. Referring to FIG. 1, a side view of an exemplary drilling machine 100 is illustrated. The drilling machine 100 will be hereinafter interchangeably referred to as the "machine 100". In the illustrated embodiment, the machine 100 is a boom mounted drilling machine. In other embodiments, the machine 100 may be any other drilling machine, such as a surface drilling machine, a rotary blasthole type drilling machine, and so on, based on application requirements. The machine 100 performs various drilling related operations, such as sub-surface mineral extraction; mineral exploration; environmental exploration; hydraulic fracturing; oil, gas, and/or water extraction wells; rock cut drilling for mining and/or quarrying operations; and so on, based on application requirements.

The machine 100 includes a chassis 102. The chassis 102 supports one or more components of the machine 100 thereon. The machine 100 also includes an operator cabin 104 mounted on the chassis 102. The operator cabin 104 may include one or more controls, such as one or more operator consoles, joysticks, pedals, levers, buttons, switches, steering, and so on. The controls are adapted to control an operation of the machine 100 on a work surface 106. It should be noted that, in many situations, the machine 100 may be an autonomous machine, a semi-autonomous machine, a remotely operated machine, a remotely supervised machine, and so on, based on application requirements.

The machine 100 also includes an enclosure 108 provided on the chassis 102. The enclosure 108 encloses a power source (not shown) mounted on the chassis 102. The power source provides power to the machine 100 for mobility and operational requirements. The power source may include, but not limited to, a diesel engine, a gasoline engine, a gaseous fuel powered engine, a dual fuel powered engine, an electric motor, a fuel cell, a battery, and/or a combination thereof, based on application requirements. Additionally, the machine 100 may include components and/or systems (not shown), such as a fuel delivery system, an air delivery system, a lubrication system, a propulsion system, a drivetrain, a drive control system, a machine control system, and so on, based on application requirements.

The machine 100 also includes a set of ground engaging members 110 (only one ground engaging member shown in the accompanying figure). The ground engaging members 110 are operably coupled to the chassis 102. In the illustrated embodiment, the ground engaging members 110 are tracks. In other embodiments, the ground engaging members 110 may be wheels. The ground engaging members 110 support and provide mobility to the machine 100 on the work surface 106. As such, the ground engaging members 110 provide movement, turning, positioning, and travel of the machine 100 on the work surface 106.

The machine 100 also includes a deck frame 112 disposed on the chassis 102. The deck frame 112 provides an operating surface on the machine 100. As such, the deck frame 112 may provide the operating surface for an operator to move around the machine 100 or be stationed on the machine 100, to support one or more components of the machine 100, and so on.

The machine 100 also includes a feed assembly 114. The feed assembly 114 includes a feed table 116 disposed on the chassis 102. The feed table 116 will be hereinafter interchangeably referred to as the "table 116". The table 116 is pivotally coupled to the chassis 102 using a boom member 118. The boom member 118 is movably coupled to the chassis 102 using a shift cylinder 120. As such, the table 116 is movable relative to the chassis 102 between a substantially vertical position (shown in the accompanying figure) and a non-vertical position (not shown) via the shift cylinder 120. Accordingly, the shift cylinder 120 provides alignment of the table 116 along a height and a width of the chassis 102. The table 116 is a linearly extending structure, and in the accompanying figure, is upright, extending along a vertical axis X-X'. The table 116 supports one or more drilling components of the machine 100.

The feed assembly 114 also includes a drill assembly 122. The drill assembly 122 is movably disposed on the table 116 via a mast 136. The drill assembly 122 is adapted for drilling holes, channels, tunnels, openings, and so on into, within, and/or extending into, and/or below, the work surface 106. Accordingly, the drill assembly 122 includes a drill bit 124 and a drill string 126 removably coupled to the drill bit 124. Accordingly, the drill assembly 122 is adapted to drill a borehole 128 into the work surface 106.

The drill string 126 includes one or more columns or pipes 130 interlinked with each other and with the drill bit 124. Each of the pipes 130 of the drill assembly 122 have a hollow and generally cylindrical configuration. The pipes 130 provide extension of the drill bit 124 into the borehole 128. For example, each pipe 130 may be coupled to another pipe 130 by way of a threaded connection (not shown). In other embodiments, the pipes 130 may be interlinked with each other by way of other similar connections, for example, by lock fittings, snap fittings, and so on, based on application requirements. The drill string 126 is slidably coupled with the table 116 via supporting rails 132 and may be driven by a motor (not shown) to slidably move relative to the table 116 on the supporting rails 132 along the vertical axis X-X'.

The feed assembly 114 also includes a carousel 134. The carousel 134 is disposed on the feed table 116 via the mast 136. The carousel 134 may store and support one or more pipes 130 of the drill assembly 122 when the drill assembly 122 or the drill string 126 is not in use. In one example, the carousel 134 includes a plurality of slots (not shown) adapted to hold the pipes 130. The carousel 134 may also be used to add pipes 130 to the drill assembly 122 to form the drill string 126 when in use. Additionally, the feed assembly 114 may include one or more components and systems (not shown), such as a drive mechanism including a motor, a chain, a sprocket, and so on; a rotary mechanism; actuators; adapters; guiding members; valves; sensors; controllers; and so on, based on application requirements.

The feed assembly 114 also includes a positioning member 138. The positioning member 138 will be hereinafter interchangeably referred to as the "positioner 138". The positioner 138 is pivotally coupled to each of the feed table 116 and the boom member 118. More specifically, referring to FIGS. 2 and 3A, the positioner 138 is pivotally coupled to the feed table 116 via a central pivot joint 202 defining a central pivot axis C-C'. Accordingly, the feed table 116 is adapted to pivot relative to the positioner 138 about the central pivot joint 202 and the central pivot axis C-C'. Also, the positioner 138 is pivotally coupled to the boom member 118 at a first hinge joint 204 defining a first hinge axis A-A'. The first hinge axis A-A' is disposed spaced apart and substantially perpendicular to the central pivot axis C-C'.

Accordingly, the positioner 138 is adapted to pivot relative to the boom member 118 about the first hinge joint 204 and the first hinge axis A-A'. Further, the positioner 138 is pivotally coupled to the shift cylinder 120 at a second hinge joint 206 defining a second hinge axis B-B'. The second hinge axis B-B' is disposed spaced apart relative to each of the central pivot axis C-C' and the first hinge axis A-A'. Also, the second hinge axis B-B' is disposed substantially perpendicular to the central pivot axis C-C' and substantially parallel to the first hinge axis A-A'. Accordingly, the positioner 138 is adapted to pivot relative to the shift cylinder 120 about the second hinge joint 206 and the second hinge axis B-B'.

Figure 2:
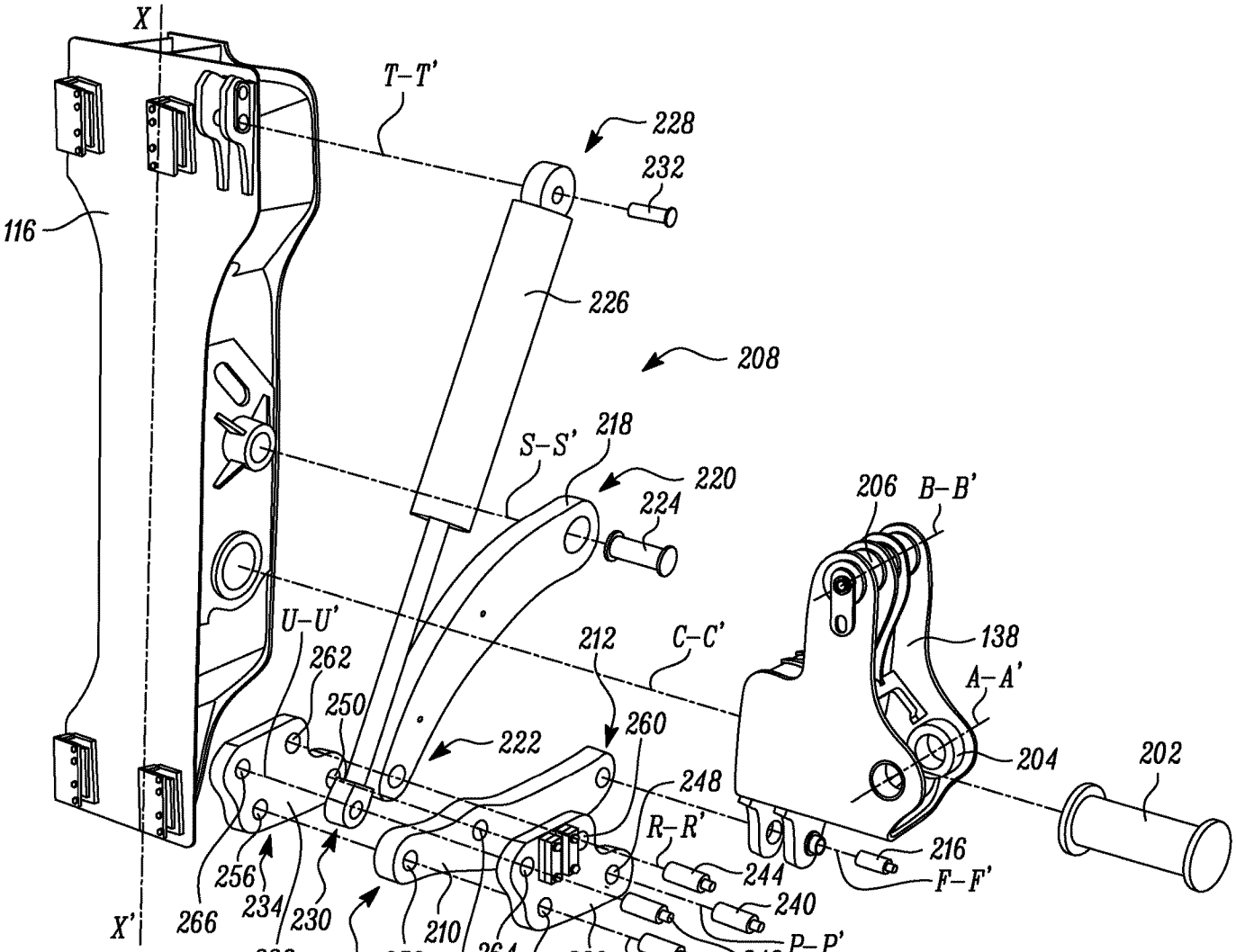
FIG. 2 is an exploded perspective view of a portion of a feed assembly of the drilling machine, according to one embodiment of the present disclosure.
Figure 3B:
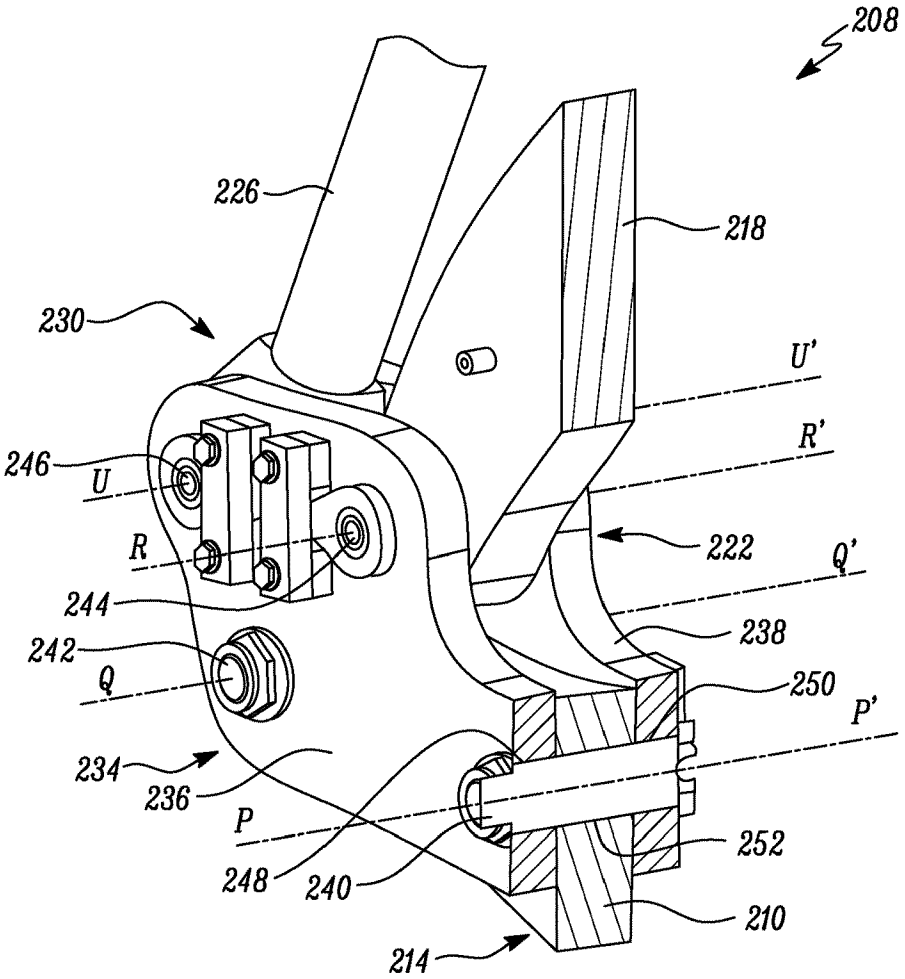
FIG. 3B is a perspective cross sectional view of a portion of the feed assembly of FIG. 3A along a section Y-Y, according to one embodiment of the present disclosure.
Figure 3A:
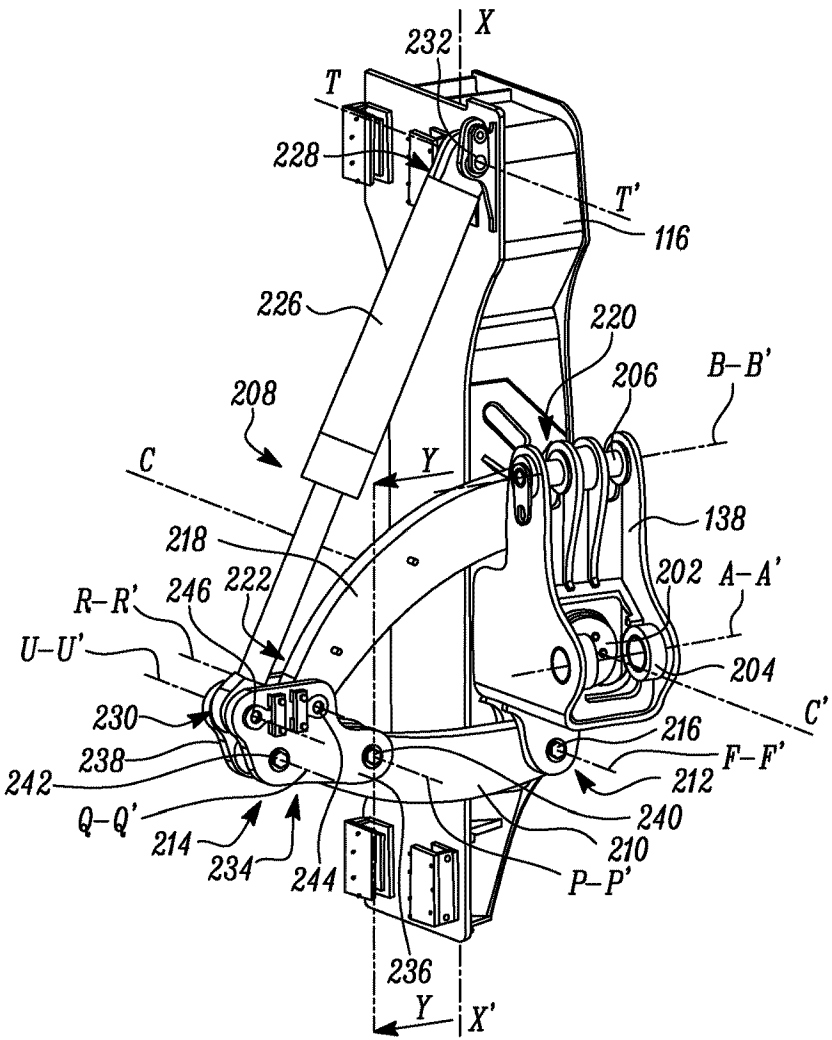
FIG. 3A is a perspective view of a portion of the feed assembly of the drilling machine, according to one embodiment of the present disclosure.
Figure 4:
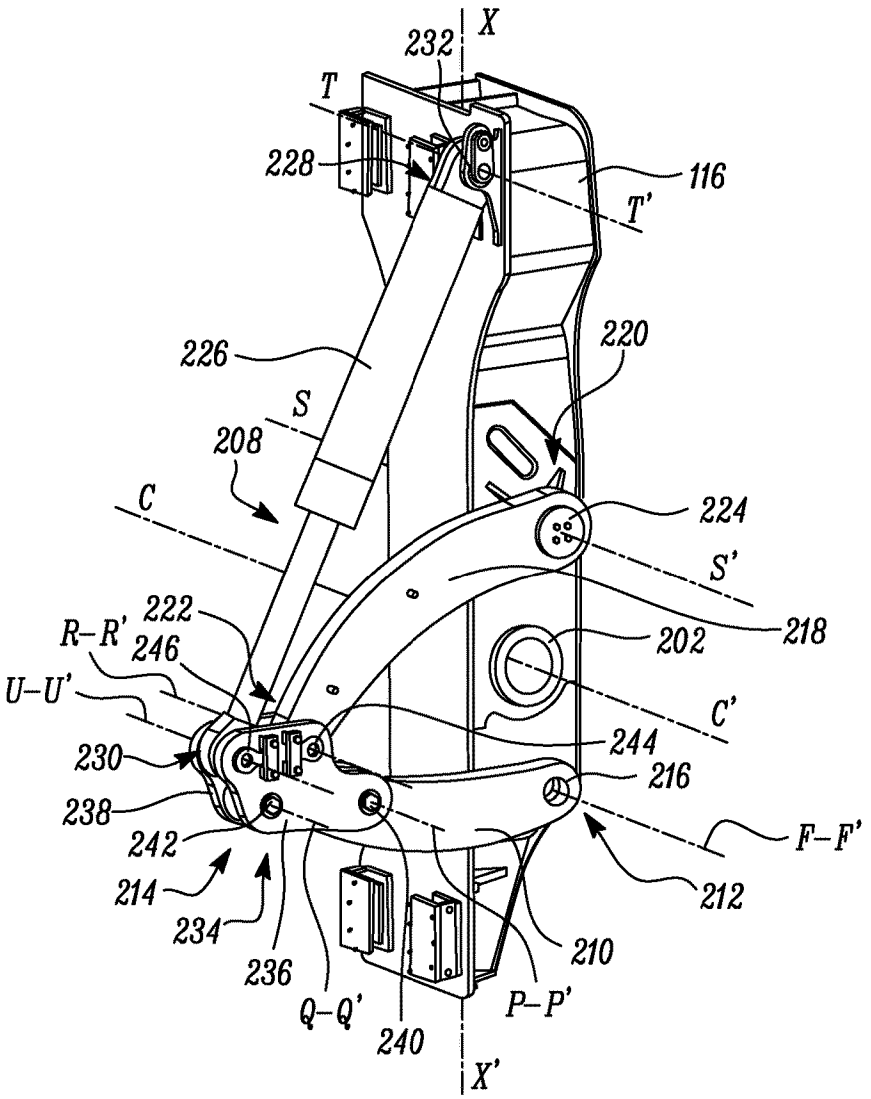
FIG. 4 is another perspective view of a portion of the feed assembly of the drilling machine, according to one embodiment of the present disclosure.

Referring to FIGS. 2, 3A, and 4, the feed assembly 114 further includes a linkage assembly 208. The linkage assembly 208 is operably coupled to each of the feed table 116 and the positioning member 138. The linkage assembly 208 will be hereinafter interchangeably referred to as the "assembly 208". The assembly 208 includes a first arm 210. The first arm 210 defines a first end 212 and a second end 214. The second end 214 is disposed opposite to the first end 212. The first end 212 of the first arm 210 is pivotally coupled to the positioner 138 at a first pivot joint 216. The first pivot joint 216 defines a first pivot axis F-F'. The first pivot axis F-F' is disposed spaced apart and substantially parallel to the central pivot axis C-C'. Accordingly, the first end 212 of the first arm 210 is adapted to pivot relative to the positioner 138 about the first pivot joint 216 and the first pivot axis F-F'. The first pivot joint 216 may be any rotating joint, such as a pin based joint, a bush based joint, a bearing based joint, a combination thereof, and so on, based on application requirements.

In the illustrated embodiment, the first arm 210 has a partially curved and elongated configuration. In other embodiments, the first arm 210 may have any other configuration, such as a substantially curved configuration, a substantially straight configuration, a bent configuration, an angled configuration, and so on, based on application requirements. Also, in the illustrated embodiment, the first arm 210 is manufactured by fabrication. In other embodiments, the first arm 210 may be manufactured using any process, such as forging, additive manufacturing, and so on, based on application requirements.

The assembly 208 also includes a second arm 218. The second arm 218 defines a first end 220 and a second end 222. The second end 222 is disposed opposite to the first end 220. The first end 220 of the second arm 218 is pivotally coupled to the feed table 116 at a second pivot joint 224. The second pivot joint 224 defines a second pivot axis S-S'. The second pivot axis S-S' is disposed spaced apart and substantially parallel to each of the central pivot axis C-C' and the first pivot axis F-F'. Accordingly, the first end 220 of the second arm 218 is adapted to pivot relative to the feed table 116 about the second pivot joint 224 and the second pivot axis S-S'. The second pivot joint 224 may be any rotating joint, such as a pin based joint, a bush based joint, a bearing based joint, a combination thereof, and so on, based on application requirements.

In the illustrated embodiment, the second arm 218 has a substantially curved and elongated configuration. In other embodiments, the second arm 218 may have any other configuration, such as a partially curved configuration, a substantially straight configuration, a bent configuration, an angled configuration, and so on, based on application requirements. Also, in the illustrated embodiment, the second arm 218 is manufactured by fabrication. In other embodiments, the second arm 218 may be manufactured using any process, such as forging, additive manufacturing, and so on, based on application requirements.

The assembly 208 also includes an actuation member 226. The actuation member 226 defines a first end 228 and a second end 230. The second end 230 is disposed opposite to the first end 228. The first end 228 of the actuation member 226 is pivotally coupled to the feed table 116 at a third pivot joint 232. The third pivot joint 232 defines a third pivot axis T-T'. The third pivot axis T-T' is disposed spaced apart from each of the central pivot axis C-C', the first pivot axis F-F', and the second pivot axis S-S'. Also, the third pivot axis T-T' is substantially parallel to each of the central pivot axis C-C', the first pivot axis F-F', and the second pivot axis S-S'. Accordingly, the first end 228 of the actuation member 226 is adapted to pivot relative to the feed table 116 about the third pivot joint 232 and the third pivot axis T-T'. The third pivot joint 232 may be any rotating joint, such as a pin based joint, a bush based joint, a bearing based joint, a combination thereof, and so on, based on application requirements.

In the illustrated embodiment, the actuation member 226 is a hydraulic actuator. Accordingly, in the illustrated embodiment, the first end 228 is a cylinder end of the actuation member 226 and the second end 230 is a rod end of the actuation member 226. In other embodiments, the actuation member 226 may be disposed in an inverted configuration, such that the first end 228 may be the rod end of the actuation member 226 and the second end 230 may be the cylinder end of the actuation member 226. Also, in other embodiments, the actuation member 226 may be any other actuator, such as an electric/electronic actuator, a magnetic actuator, and so on, based on application requirements. The actuation member 226 is adapted to move between an extended position "EP", an intermediate position "IP", and a retracted position "RP", and will be explained in more detail later.

The assembly 208 further includes a connector assembly 234. The connector assembly 234 will be hereinafter interchangeably referred to as the "connector 234". The connector 234 is coupled to each of the first arm 210, the second arm 218, and the actuation member 226. Referring to FIGS. 2 and 3B, the connector 234 includes a first plate 236 and a second plate 238. The second plate 238 is disposed spaced apart and substantially parallel to the first plate 236. Each of the first plate 236 and the second plate 238 is fixedly coupled to the second end 214 of the first arm 210 using a first fastener 240 and a second fastener 242.

More specifically, the first fastener 240 is provided through each of a first bore 248 of the first plate 236, a second bore 250 of the second plate 238, and a first arm bore 252 on the second end 214 of the first arm 210 in order to fixedly couple the second end 214 of the first arm 210 to the connector 234. Also, the second fastener 242 is provided through each of a third bore 254 of the first plate 236, a fourth bore 256 of the second plate 238, and a second arm bore 258 on the second end 214 of the first arm 210 in order to fixedly couple the second end 214 of the first arm 210 to the connector 234. Each of the first arm bore 252 and the second arm bore 258 is disposed spaced apart from one another on the second end 214 of the first arm 210, such that relative motion between the first arm 210 and the connector 234 is limited. The first fastener 240 defines a first fastener axis P-P', and the second fastener 242 defines a second fastener axis Q-Q'. The second fastener 242 is disposed spaced apart from the first fastener 240. Accordingly, the second fastener axis Q-Q' is disposed spaced apart and substantially parallel to the first fastener axis P-P'.

Also, each of the first plate 236 and the second plate 238 is pivotally coupled to the second end 222 of the second arm 218 using a first pivot pin 244. More specifically, the first pivot pin 244 is provided through each of a fifth bore 260 of the first plate 236, a sixth bore 262 of the second plate 238, and the second end 222 of the second arm 218 in order to pivotally couple the second end 222 of the second arm 218 to the connector 234. The first pivot pin 244 defines a first pivot pin axis R-R'. As such, the second end 222 of the second arm 218 is adapted to pivot relative to each of the first plate 236 and the second plate 238 about the first pivot pin 244 and the first pivot pin axis R-R'. The first pivot pin 244 is disposed spaced apart from each of the first fastener 240 and the second fastener 242. Accordingly, the first pivot pin axis R-R' is disposed spaced apart and substantially parallel to each the first fastener axis P-P' and the second fastener axis Q-Q'.

Further, each of the first plate 236 and the second plate 238 is pivotally coupled to the second end 230 of the actuation member 226 using a second pivot pin 246. More specifically, the second pivot pin 246 is provided through each of a seventh bore 264 of the first plate 236, an eighth bore 266 of the second plate 238, and the second end 230 of the actuation member 226 in order to pivotally couple the second end 230 of the actuation member 226 to the connector 234. The second pivot pin 246 defines a second pivot pin axis U-U'. As such, the second end 230 of the actuation member 226 is adapted to pivot relative to each of the first plate 236 and the second plate 238 about the second pivot pin 246 and the second pivot pin axis U-U'. The second pivot pin 246 is disposed spaced apart from each of the first fastener 240, the second fastener 242, and the first pivot pin 244. Accordingly, the second pivot pin axis U-U' is disposed spaced apart and substantially parallel to each the first fastener axis P-P', the second fastener axis Q-Q', and the first pivot pin axis R-R'.

In the illustrated embodiment, each of the first fastener 240 and the second fastener 242 is a threaded fastener, such as a nut and bolt fastener. In other embodiments, one or more of the first fastener 240 and the second fastener 242 may be any fastening element, such as a screw fastener, a bush based fastener, other pin based fastener, and so on based on application requirements. Also, in the illustrated embodiment, each of the first pivot pin 244 and the second pivot pin 246 is a shear pin. In other embodiments, one or more of the first pivot pin 244 and the second pivot pin 246 may be any rotating joint, such as a bush based joint, a bearing based joint, other pin based joint, a combination thereof, and so on, based on application requirements.

In the illustrated embodiment, each of the first plate 236 and the second plate 238 has a substantially flat and curved configuration. In other embodiments, one or more of the first plate 236 and the second plate 238 may have any other configuration, such as a stepped configuration, a bent configuration, an angled configuration, a rectangular configuration, an elliptical configuration, and so on, based on application requirements. Also, in the illustrated embodiment, each of the first plate 236 and the second plate 238 is manufactured by fabrication. In other embodiments, one or more of the first plate 236 and the second plate 238 may be manufactured using any process, such as forging, additive manufacturing, and so on, based on application requirements.

Figure 5:
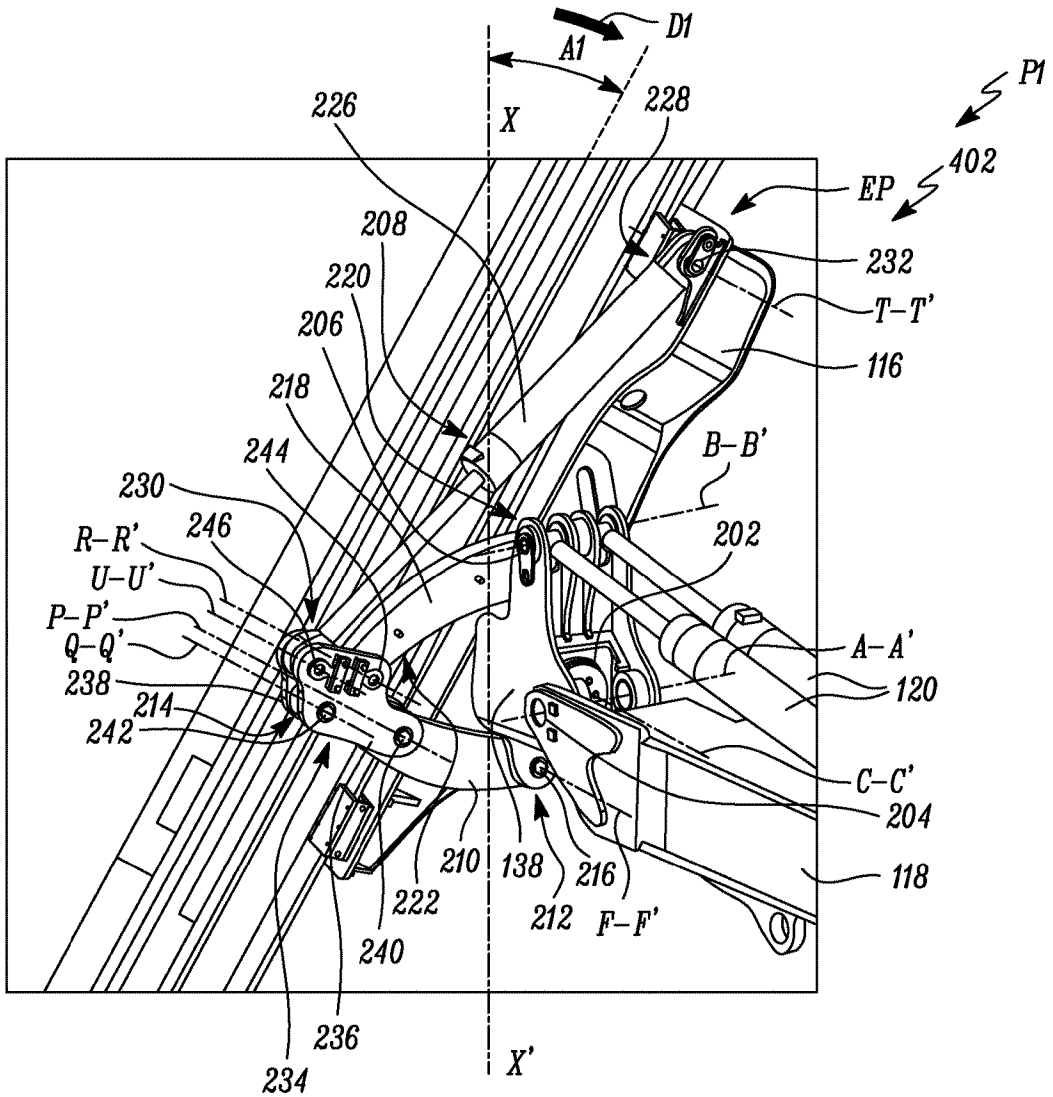
FIG. 5 is a perspective view showing an operating position of a linkage assembly associated with the feed assembly, according to one embodiment of the present disclosure.

The linkage assembly 208 is adapted to pivot the feed table 116 relative to the positioning member 138 about the central pivot axis C-C' based, at least in part, on movement of the actuation member 226 between the extended position "EP" and the retracted position "RP". For example, referring to FIG. 5, the actuation member 226 is shown in the extended position "EP". In the extended position "EP" of the actuation member 226, a pivotal movement of each of the first arm 210, the second arm 218, and the actuation member 226 pivots the table 116 in a first position "P1" in a direction "D1" relative to the vertical axis X-X'.

More specifically, the first end 212 of the first arm 210 is pivoted about the first pivot axis F-F', the first end 220 of the second arm 218 is pivoted about the second pivot axis S-S', the second end 222 of the second arm 218 is pivoted about the first pivot pin axis R-R', the first end 228 of the actuation member 226 is pivoted about the third pivot axis T-T', and the second end 230 of the actuation member 226 is pivoted about the second pivot pin axis U-U' in order to pivot the table 116 in the first position "P1" in the direction "D1" about the central pivot axis C-C'. In the first position "P1", the table 116 defines an angle "A1" with respect to the vertical axis X-X'. The angle "A1" is disposed on a first side 402 of the machine 100 relative to the vertical axis X-X'. In the illustrated embodiment, the angle "A1" measure approximately 32 degrees (°). It should be noted that, in other embodiments, an actual value of the angle "A1" may vary, based on application requirements.

Figure 6:
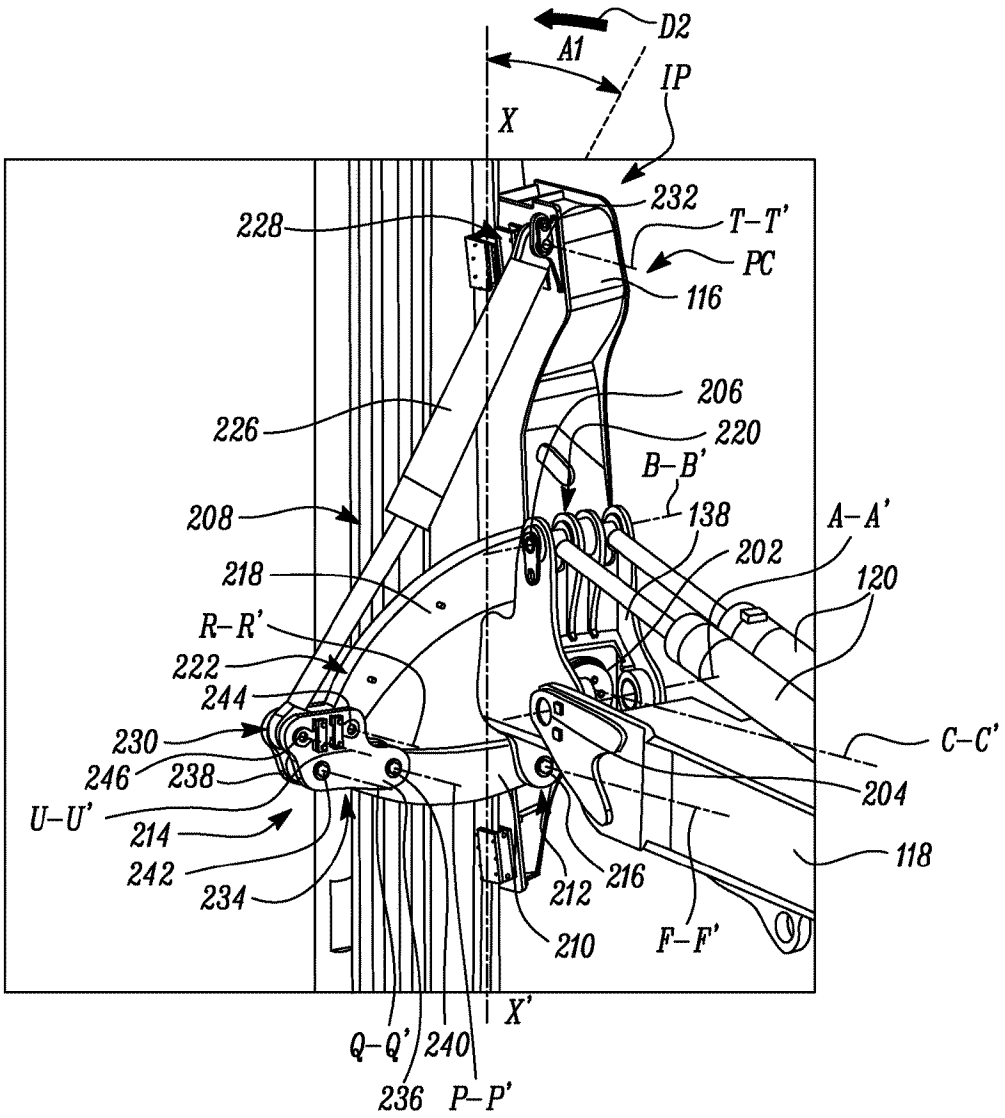
FIG. 6 is a perspective view showing another operating position of the linkage assembly associated with the feed assembly, according to one embodiment of the present disclosure.

Referring to FIG. 6, the actuation member 226 is shown in the intermediate position "IP". In the intermediate position "IP" of the actuation member 226, the pivotal movement of each of the first arm 210, the second arm 218, and the actuation member 226 pivots the table 116 in a center position "PC" in a direction "D2" relative to the vertical axis X-X'. More specifically, the first end 212 of the first arm 210 is pivoted about the first pivot axis F-F', the first end 220 of the second arm 218 is pivoted about the second pivot axis S-S' (see FIG. 7), the second end 222 of the second arm 218 is pivoted about the first pivot pin axis R-R', the first end 228 of the actuation member 226 is pivoted about the third pivot axis T-T', and the second end 230 of the actuation member 226 is pivoted about the second pivot pin axis U-U' in order to pivot the table 116 in the center position "PC" in the direction "D2" about the central pivot axis C-C'. In the center position "PC", the table 116 is aligned along the vertical axis X-X'.

Figure 7:
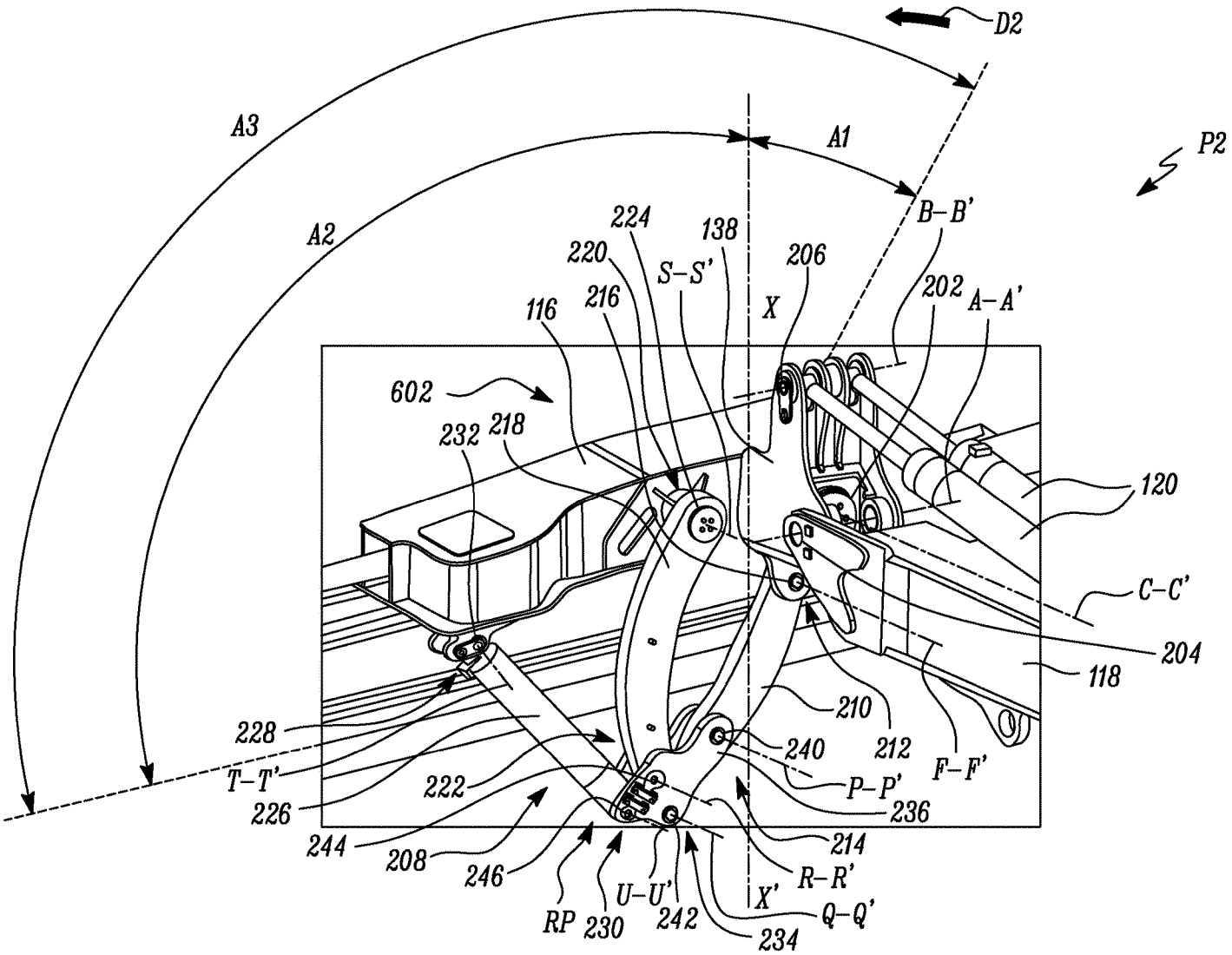
FIG. 7 is a perspective view showing yet another operating position of the linkage assembly associated with the feed assembly, according to one embodiment of the present disclosure.

Referring to FIG. 7, the actuation member 226 is shown in the retracted position "RP". In the retracted position "RP" of the actuation member 226, the pivotal movement of each of the first arm 210, the second arm 218, and the actuation member 226 pivots the table 116 in a second position "P2" in the direction "D2" relative to the vertical axis X-X'. More specifically, the first end 212 of the first arm 210 is pivoted about the first pivot axis F-F', the first end 220 of the second arm 218 is pivoted about the second pivot axis S-S', the second end 222 of the second arm 218 is pivoted about the first pivot pin axis R-R', the first end 228 of the actuation member 226 is pivoted about the third pivot axis T-T', and the second end 230 of the actuation member 226 is pivoted about the second pivot pin axis U-U' in order to pivot the table 116 in the second position "P2" in the direction "D2" about the central pivot axis C-C'. In the second position "P2", the table 116 defines an angle "A2" with respect to the vertical axis X-X'. The angle "A2" is disposed on a second side 602 of the machine 100 relative to the vertical axis X-X'. In the illustrated embodiment, the angle "A2" measure approximately 95°. It should be noted that, in other embodiments, an actual value of the angle "A2" may vary, based on application requirements.

Accordingly, in the illustrated embodiment, a pivotal range of the feed table 116 between the first position "P1" and the second position "P2" about the central pivot axis C-C' is defined by an angle "A3". As such, the angle "A3" is a sum of the angle "A1" and the angle "A2". In the illustrated embodiment, the pivotal range of the table 116 defined by the angle "A3" is approximately 127°. In other embodiments, an actual value of the pivotal range may vary, based on application requirements. For example, based on an overall configuration, geometry, orientation, location, dimension, structure, and so on of one or more of the first arm 210, the second arm 218, the actuation member 226, and the connector 234, one or more of the angle "A1" and the angle "A2" may have varying operational values and, thus, the pivotal range of the table 116 may be less than or greater than 127°, as the case may be.

Also, in the illustrated embodiment, the assembly 208 is disposed on the second side 602 of the machine 100. In other embodiments, the assembly 208 may be alternatively disposed on the first side 402 of the machine 100. In such a situation, the first position "P1" of the table 116 may be alternatively disposed on the second side 602 of the machine 100, and the second position "P2" of the table 116 may be disposed on the first side 402 of the machine 100. Additionally, in the illustrated embodiment, although the center position "PC" of the table 116 is described with reference to the intermediate position "IP" of the actuation member 226, the table 116 may be pivoted in any other operating position between the first position "P1" and the second position "P2" based on any other intermediate operating position of the actuation member 226 between the extended position "EP" and the retracted position "RP".

Further, in the illustrated embodiment, the table 116 is pivoted in the first position "P1" in the extended position "EP" of the actuation member 226 and in the second position "P2" in the retracted position "RP" of the actuation member 226. In other embodiments, based on the overall configuration, geometry, orientation, location, dimension, structure, and so on of one or more of the first arm 210, the second arm 218, the actuation member 226, and the connector 234, the table 116 may be pivoted in the first position "P1" in the retracted position "RP" of the actuation member 226 and in the second position "P2" in the extended position "EP" of the actuation member 226.

INDUSTRIAL APPLICABILITY

The present disclosure relates to the linkage assembly 208 for the feed table 116 of the machine 100. The assembly 208 includes the first arm 210, the second arm 218, the actuation member 226, and the connector 234 in order to provide the pivotal movement of the table 116 about the central pivot joint 202. The first arm 210, the second arm 218, and each of the first plate 236 and the second plate 238 of the connector 234 are manufactured by fabrication, in turn, reducing an overall weight of the assembly 208, reducing cost, reducing operating power for movement of the table 116, reducing size of the actuation member 226, and improving an overall performance of the assembly 208. The connector 234 is positioned on the second ends 214, 222, 230 of each of the first arm 210, the second arm 218, and the actuation member 226, respectively, in turn, optimizing geometry of the assembly 208 and, thus, reducing force required for movement of the table 116 and improving the overall performance of the assembly 208.

The assembly 208 provides a smooth pivotal movement of the table 116 about the central pivot joint 202 with improved pivotal speed control, in turn, improving operational control and performance. The assembly 208 includes simple, readily available, and easily manufactured components, such as the first arm 210, the second arm 218, the actuation member 226, the first plate 236, the second plate 238, the first fastener 240, the second fastener 242, the first pivot pin 244, the second pivot pin 246, the central pivot joint 202, the first hinge joint 204, the second hinge joint 206, the first pivot joint 216, the second pivot joint 224, the third pivot joint 232, and so on, in turn, reducing complexity, bulk, weight, and cost of the assembly 208. The assembly 208 may be retrofitted on any machine with little or no modification to existing system, in turn, providing compatibility and flexibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A linkage assembly for a drilling machine, the linkage assembly comprising:

a first arm defining a first end and a second end opposite to the first end, the first end of the first arm pivotally coupled to a positioning member at a first pivot joint;

a second arm defining a first end and a second end opposite to the first end, the first end of the second arm pivotally coupled to a feed table at a second pivot joint;

an actuation member defining a first end and a second end opposite to the first end, the first end of the actuation member pivotally coupled to the feed table at a third pivot joint; and a connector assembly directly fixedly coupled to the second end of the first arm, and directly pivotally coupled to each of the second end of the second arm and the second end of the actuation member, wherein the linkage assembly is to pivot the feed table relative to the positioning member about a pivot axis based on movement of the actuation member between an extended position and a retracted position.

2. The linkage assembly of claim 1, wherein the connector assembly includes:

a first plate; and a second plate spaced apart from the first plate, and wherein each of the first plate and the second plate is fixedly coupled to the second end of the first arm, and pivotally coupled to each of the second end of the second arm and the second end of the actuation member.

3. The linkage assembly of claim 2, wherein the second end of the first arm is fixedly coupled to each of the first plate and the second plate using a first fastener and a second fastener spaced apart from the first fastener.

4. The linkage assembly of claim 3, wherein the second end of the second arm is pivotally coupled to each of the first plate and the second plate using a first pivot pin spaced apart from each of the first fastener and the second fastener.

5. The linkage assembly of claim 4, wherein the second end of the actuation member pivotally coupled to each of the first plate and the second plate using a second pivot pin spaced apart from each of the first fastener, the second fastener, and the first pivot pin.

6. The linkage assembly of claim 5, wherein each of the first pivot pin and the second pivot pin is a shear pin.

7. The linkage assembly of claim 2, wherein each of the first arm, the second arm, the first plate, and the second plate is manufactured by fabrication.

8. The linkage assembly of claim 1, wherein a pivotal range of the feed table about the pivot axis is 127 degrees (°).

9. A feed assembly for a drilling machine, the feed assembly comprising:

a feed table adapted to receive a drill assembly;

a positioning member pivotally coupled to each of the feed table and a boom member associated with the drilling machine; and a linkage assembly operably coupled to the feed table and the positioning member, the linkage assembly including:

a first arm defining a first end and a second end opposite to the first end, the first end of the first arm pivotally coupled to the positioning member at a first pivot joint;

a second arm defining a first end and a second end opposite to the first end, the first end of the second arm pivotally coupled to the feed table at a second pivot joint;

an actuation member defining a first end and a second end opposite to the first end, the first end of the actuation member pivotally coupled to the feed table at a third pivot joint; and a connector assembly directly fixedly coupled to the second end of the first arm, and directly pivotally coupled to each of the second end of the second arm and the second end of the actuation member, wherein the linkage assembly is to pivot the feed table relative to the positioning member about a pivot axis based on movement of the actuation member between an extended position and a retracted position.

10. The feed assembly of claim 9, wherein the connector assembly includes:

a first plate; and a second plate spaced apart from the first plate, and wherein each of the first plate and the second plate is fixedly coupled to the second end of the first arm, and pivotally coupled to each of the second end of the second arm and the second end of the actuation member.

11. The feed assembly of claim 10, wherein the second end of the first arm is fixedly coupled to each of the first plate and the second plate using a first fastener and a second fastener spaced apart from the first fastener.

12. The feed assembly of claim 11, wherein the second end of the second arm is pivotally coupled to each of the first plate and the second plate using a first pivot pin spaced apart from each of the first fastener and the second fastener.

13. The feed assembly of claim 12, wherein the second end of the actuation member pivotally coupled to each of the first plate and the second plate using a second pivot pin spaced apart from each of the first fastener, the second fastener, and the first pivot pin.

14. The feed assembly of claim 13, wherein each of the first pivot pin and the second pivot pin is a shear pin.

15. The feed assembly of claim 10, wherein each of the first arm, the second arm, the first plate, and the second plate is manufactured by fabrication.

16. A drilling machine comprising:

a chassis;

a boom member movably coupled to the chassis;

a feed table pivotally coupled to the boom member;

a positioning member pivotally coupled to each of the feed table and the boom member; and a linkage assembly operably coupled to the feed table and the positioning member, the linkage assembly including:

a first arm defining a first end and a second end disposed opposite to the first end, the first end of the first arm pivotally coupled to the positioning member at a first pivot joint;

a second arm defining a first end and a second end disposed opposite to the first end, the first end of the second arm pivotally coupled to the feed table at a second pivot joint;

an actuation member defining a first end and a second end disposed opposite to the first end, the first end of the actuation member pivotally coupled to the feed table at a third pivot joint; and a connector assembly fixedly coupled to the second end of the first arm, and pivotally coupled to each of the second end of the second arm and the second end of the actuation member, wherein the linkage assembly is adapted to pivot the feed table relative to the positioning member about a pivot axis based on movement of the actuation member between an extended position and a retracted position, wherein the connector assembly includes:

a first plate; and a second plate disposed spaced apart from the first plate, and wherein each of the first plate and the second plate is fixedly coupled to the second end of the first arm, and pivotally coupled to each of the second end of the second arm and the second end of the actuation member.

17. The drilling machine of claim 16, wherein the second end of the first arm is fixedly coupled to each of the first plate and the second plate using a first fastener and a second fastener disposed spaced apart from the first fastener.

18. The drilling machine of claim 17, wherein:

the second end of the second arm is pivotally coupled to each of the first plate and the second plate using a first pivot pin disposed spaced apart from each of the first fastener and the second fastener, and the second end of the actuation member pivotally coupled to each of the first plate and the second plate using a second pivot pin disposed spaced apart from each of the first fastener, the second fastener, and the first pivot pin.

19. The drilling machine of claim 16, wherein each of the first arm, the second arm, the first plate, and the second plate is manufactured by fabrication.

* * * * *